US012782068B1

(12) United States Patent
Reichard

(10) Patent No.: US 12,782,068 B1
(45) Date of Patent: Nov. 3, 2026

(54) DEVICE AND METHOD FOR SEALING A FIREARM GAS KEY

(71) Applicant: FN Herstal, S.A., Herstal (BE)

(72) Inventor: Maxwell Reichard, Columbia, SC (US)

(73) Assignee: FN Herstal, S.A., Herstal (BE)

( * ) Notice: Subject to any disclaimer, the term of this patent is extended or adjusted under 35 U.S.C. 154(b) by 0 days.

(21) Appl. No.: 19/331,606

(22) Filed: Sep. 17, 2025

(51) Int. Cl.
*F41A 5/24* (2006.01)

(52) U.S. Cl.
CPC ..... *F41A 5/24* (2013.01)

(58) Field of Classification Search
CPC ..... F41A 5/24; F41A 3/26; F41A 3/36
See application file for complete search history.

(56) References Cited

U.S. PATENT DOCUMENTS

| | | | | |
|---|---|---|---|---|
| 7,316,091 | B1 * | 1/2008 | Desomma | F41A 3/26 42/16 |
| 7,784,211 | B1 | 8/2010 | Desomma | |
| 8,375,616 | B2 * | 2/2013 | Gomez | F41A 5/18 42/16 |
| 8,991,295 | B2 | 3/2015 | Larue | |
| 9,470,469 | B2 | 10/2016 | Daniel et al. | |
| 9,803,941 | B2 * | 10/2017 | LaRue | F41A 5/20 |
| 10,422,596 | B2 * | 9/2019 | Kramer | F41A 5/24 |
| 10,718,577 | B1 * | 7/2020 | Sylvester | F41A 5/26 |
| 11,079,191 | B1 * | 8/2021 | Sugg | F41A 5/24 |
| 11,959,715 | B1 * | 4/2024 | Noonan | F41A 19/10 |
| 2008/0000128 | A1 * | 1/2008 | Newman | F41A 5/02 42/16 |
| 2014/0318361 | A1 * | 10/2014 | Larue | F41A 5/24 89/193 |
| 2015/0241149 | A1 * | 8/2015 | Mcmillen, IV | F41A 5/28 89/193 |
| 2016/0178308 | A1 * | 6/2016 | Daniel | F16J 15/08 89/193 |
| 2017/0045321 | A1 * | 2/2017 | Larue | F41A 5/28 |
| 2020/0240726 | A1 * | 7/2020 | Spangler | F41A 3/26 |
| 2021/0010767 | A1 * | 1/2021 | Young | F41A 5/18 |
| 2022/0307599 | A1 * | 9/2022 | Larson | F16J 15/0825 |
| 2022/0341692 | A1 * | 10/2022 | Markut | F41A 19/13 |

* cited by examiner

*Primary Examiner* — Joshua E Freeman
(74) *Attorney, Agent, or Firm* — Williams Mullen; Thomas F. Bergert

(57) ABSTRACT

A gas key gasket and method seals a firearm's gas system at the interface between the bolt carrier body and the gas key. In various embodiments, the gasket is metallic with an embossment at the gas hole. In embodiments, the embossment compresses and provides one or more contact rings at the interface. The contact ring(s) promote a method of sealing the irregular surfaces around the gas path, which provides a level of consistency to the seal.

18 Claims, 6 Drawing Sheets

DEVICE AND METHOD FOR SEALING A FIREARM GAS KEY

TECHNICAL FIELD

The present disclosure relates to firearms and more particularly to an interface between a gas key and a bolt carrier body of a firearm.

BACKGROUND AND SUMMARY

Semi-automatic and fully automatic tactical rifles have a bolt carrier within the receiver of the firearm. A gas key catches the gas coming through the gas tube and transmits the gas force into the rest of the bolt carrier group to cycle the firearm during operation.

Traditionally, gasket adhesives have been used to seal the interface between the bolt carrier body of the firearm and the gas key. However, on a large scale this method is not repeatable due to the nature of application. Quality levels suffer, and the seal is inconsistent. When the seal is inconsistent, gas can leak at the interface between the gas key and the carrier body, which decreases the gas pressure entering the bolt chamber of the bolt carrier, thereby decreasing the gas that is needed to apply pressure to the bolt carrier. Additionally, the durability of the interface is inconsistent. Seals can either improve or degrade through use or age with no apparent predictability.

An effective seal at the interface between the gas key and the bolt carrier body is needed to eliminate or substantially reduce the opportunity for cartridge gas to leak during operation of the firearm.

Embodiments of the present disclosure effectively seal a firearm's gas system at the interface between the bolt carrier body and the gas key. This is accomplished according to embodiments disclosed herein by assembling a sacrificial gasket part to the fastened joint. In various embodiments, the gasket is metallic with an embossment at the gas hole. When the gasket is assembled to the joint, the embossment of the gasket compresses and provides one or more contact rings at the interface between the gas key and the carrier body. The contact ring(s) promote a method of sealing the irregular surfaces around the gas path, which provides a level of consistency to the seal. Because the bolt carrier and gas key are very rigid, any surface irregularities at the fastened joint need to be addressed and/or taken up. The embossment of the gasket acts as a spring that compresses to take up irregularities of the surfaces. No gasket adhesive is needed to provide an adequate seal and no O-ring or O-ring groove is necessary.

DETAILED DESCRIPTION OF EMBODIMENTS

Figure 1:
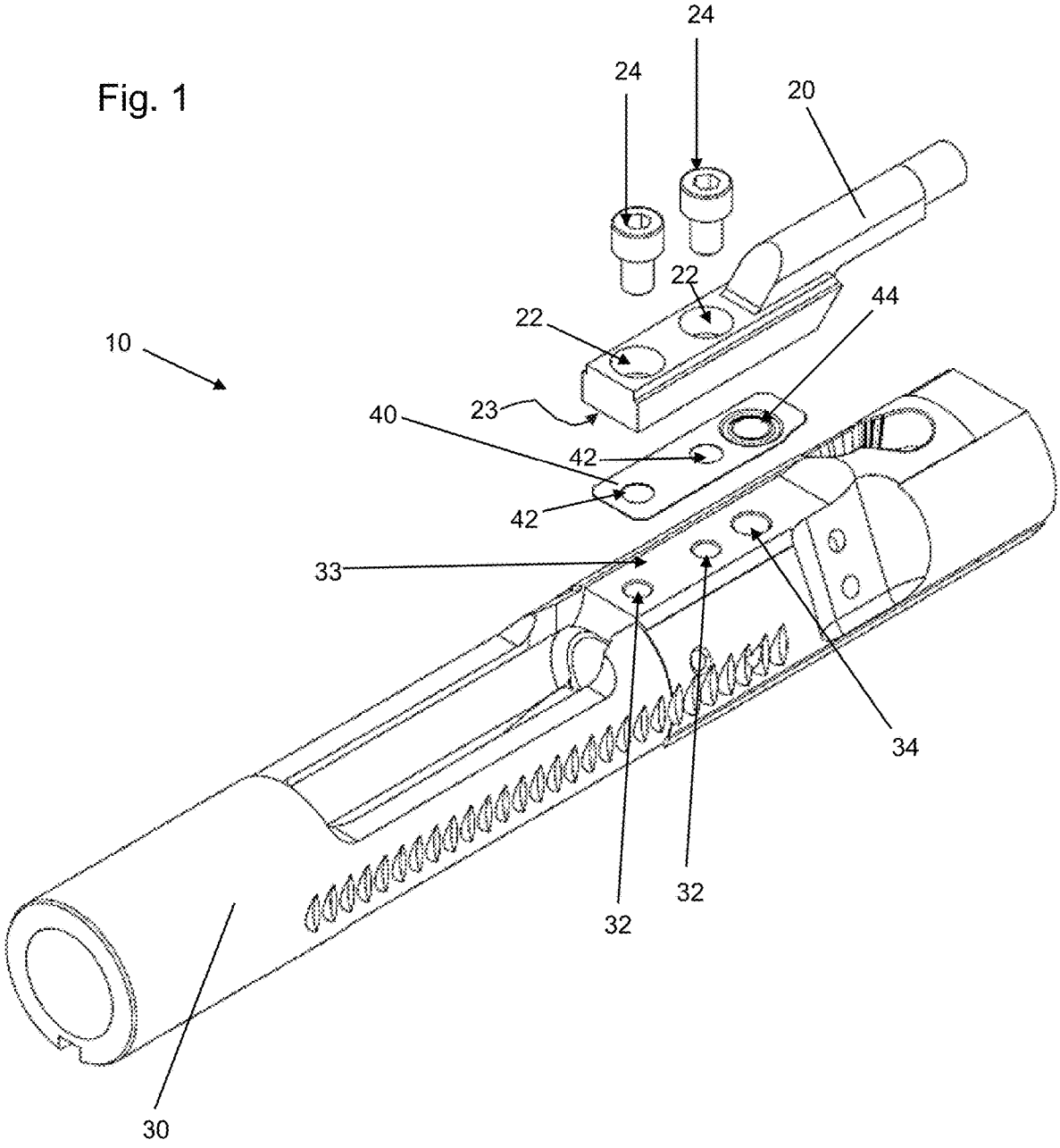
FIG. 1 is an exploded perspective view of a firearm with a gas key gasket according to embodiments of the present disclosure.
Figure 2:
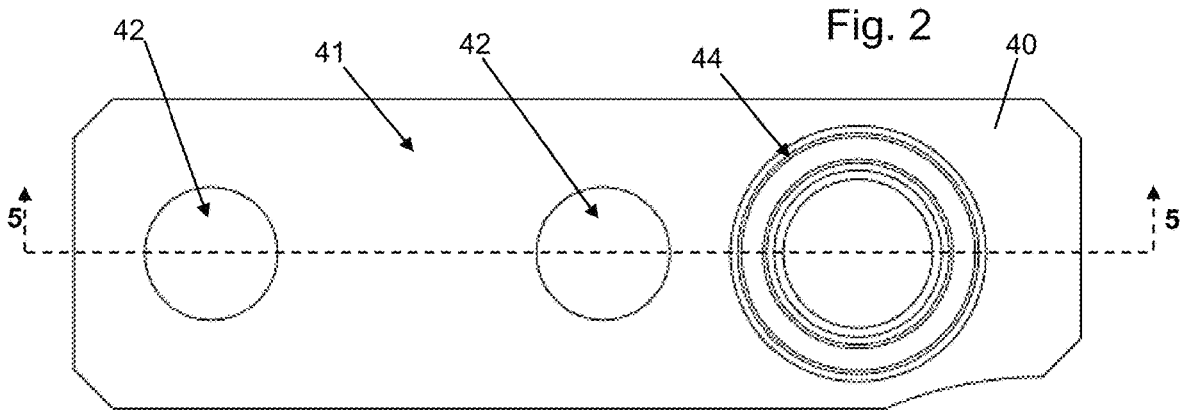
FIG. 2 is a top plan view of a gas key gasket according to embodiments of the present disclosure.
Figure 3:
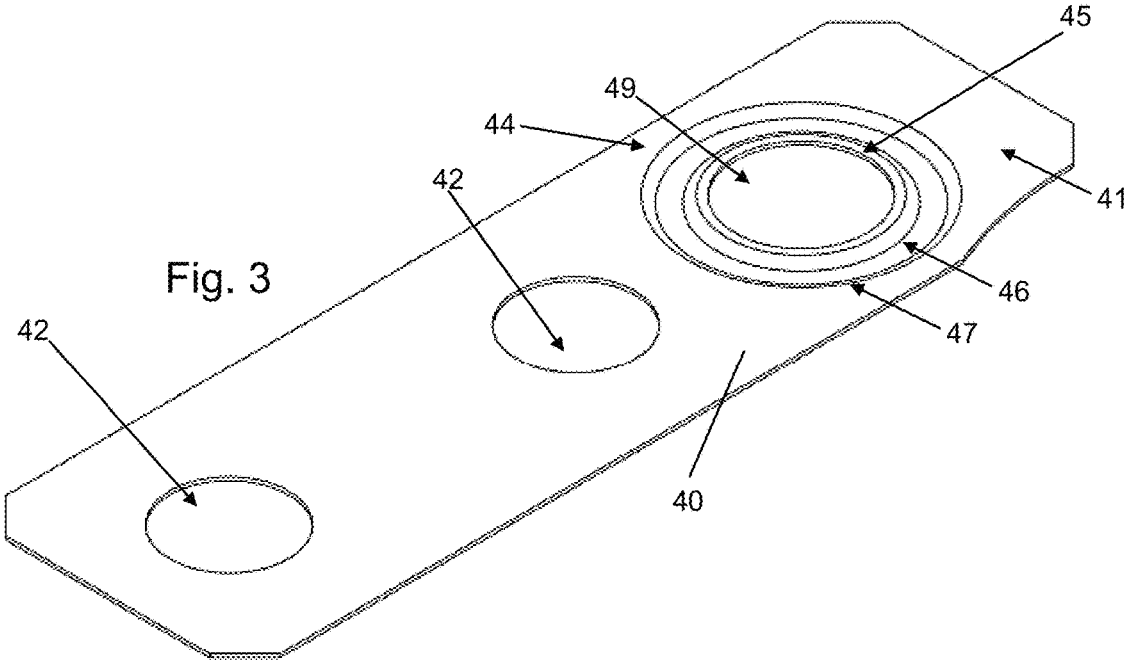
FIG. 3 is a top perspective view of a gas key gasket according to embodiments of the present disclosure.
Figure 4:
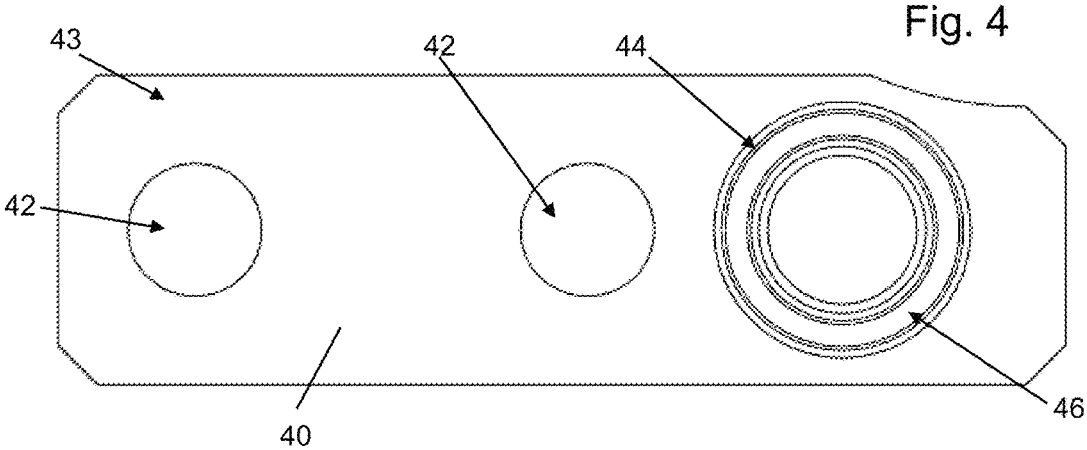
FIG. 4 is a bottom view of a gas key gasket according to embodiments of the present disclosure.

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims. In addition, the present disclosure describes, among other things, a premises management system, device and method. Although embodiments herein are described with respect to their application in certain environments and locations, it is understood that the presently described embodiments can be implemented in any setting where access control may be useful.

It will be appreciated that reference to "a", "an" or other indefinite article in the present disclosure encompasses one or more than one of the described element. Thus, for example, reference to a screw may encompass one or more screws, and so forth.

According to embodiments of the present disclosure as shown in FIGS. 1 through 9, a gas key gasket 40 for a firearm assembly 10 is provided as a monolithic body formed from a metallic material (e.g., stainless steel) and formed with a gas opening 49 and a ridge embossment 44 extending circumferentially around the opening 49. In various embodiments, the ridge embossment 44 can be positioned about a gas opening 34 in a bolt carrier 30 of a firearm 10 and compressed by a bolt carrier gas key 20 so as to seal one or more irregular surfaces on the bolt carrier gas key 20 and/or the bolt carrier 30. In various embodiments, the gasket 40 is formed as a substantially flat plane, with a top surface 41 that engages with an underside planar surface 23 of the gas key 20 and a bottom surface 43 that engages with a top planar surface 33 of the bolt carrier body 30.

The gas key gasket 40 can also be formed with one or more openings 42 for mating with corresponding gas key opening(s) 22 and bolt carrier body opening(s) 32 to permit screw(s) 24 to pass through to secure the gas key 20 to the bolt carrier body 30. In various embodiments, the screw(s) 24 is threaded and engages a corresponding thread in the surfaces defining the bolt carrier body opening(s) 32.

It will be appreciated that the underside planar surface 23 of the gas key 20 and the top planar surface 33 of the bolt carrier body 30 are irregular surfaces that have some level of deformity, which creates avenues for gas to escape if not properly sealed, such as by using the gas key gasket 40 according to the present disclosure. In various embodiments, the gasket 40 seals the one or more irregular surfaces without adhesive.

Figure 5:
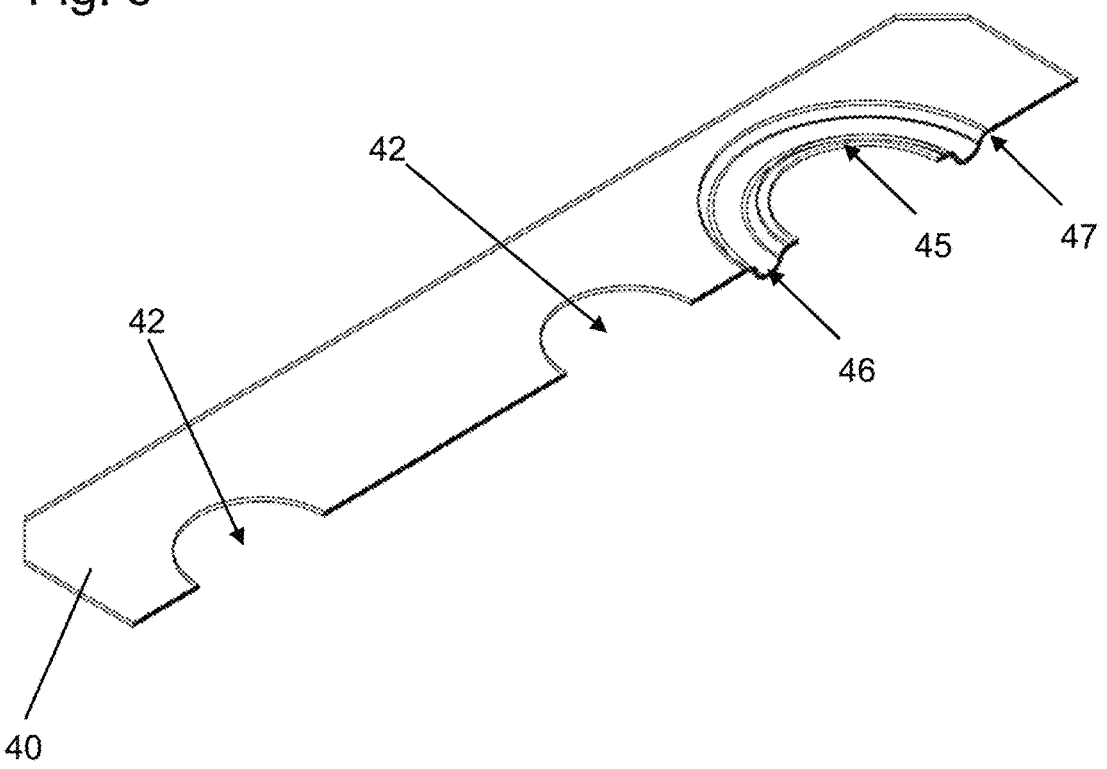
FIG. 5 is a perspective view of a cross-section of the gas key gasket taken along the line 5-5 of FIG. 2.
Figure 6:
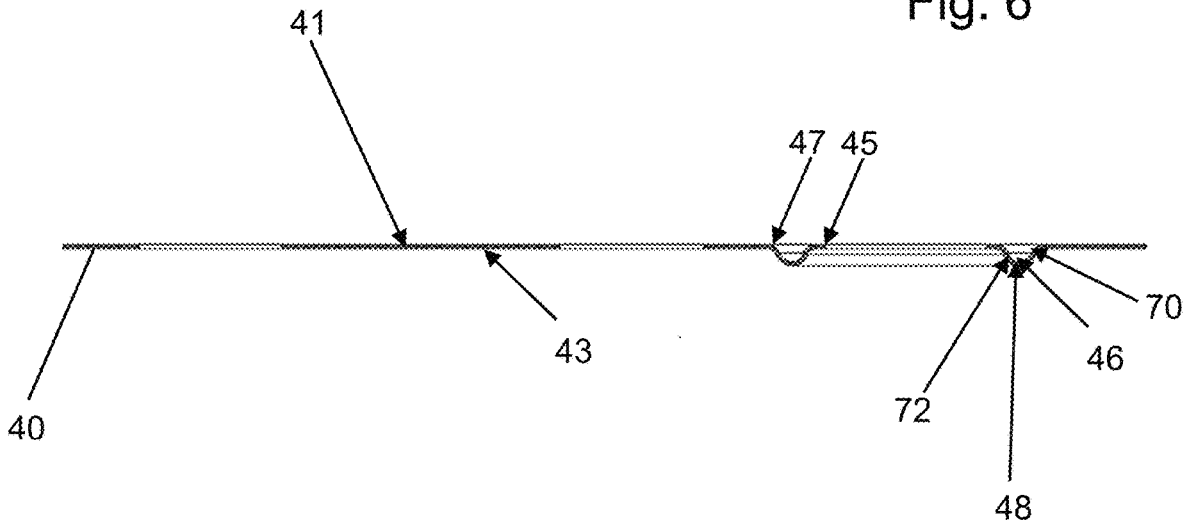
FIG. 6 is a front view of the cross-section of the gas key gasket taken along the line 5-5 of FIG. 2.
Figure 7:
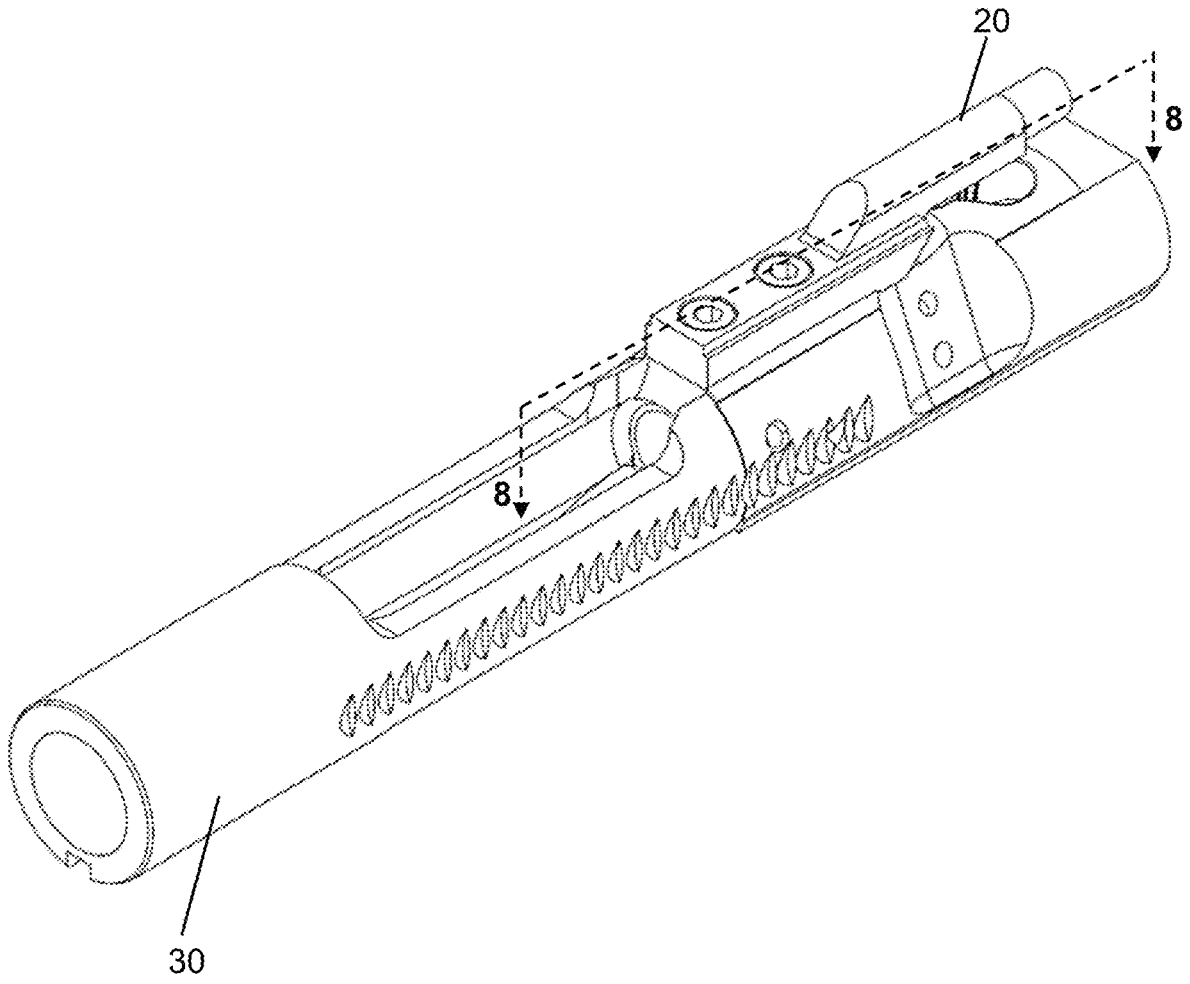
FIG. 7 is a perspective view of a firearm assembly with a gas key gasket and gas key according to embodiments of the present disclosure.

According to embodiments as disclosed herein, the ridge embossment 44 is formed with a radially interior lip 45, a central ridge 46 and a radially exterior lip 47. In various embodiments, the radially exterior lip 47 is an edge of the plane corresponding to the top surface 41 of the gas key gasket 40, the central ridge 46 extends downwardly as a first concave arc 70 to a peak 48 and then further as an opposing concave arc 72 from the peak 48 to the radially interior lip 45, as shown in FIGS. 5 and 6.

Figure 8:
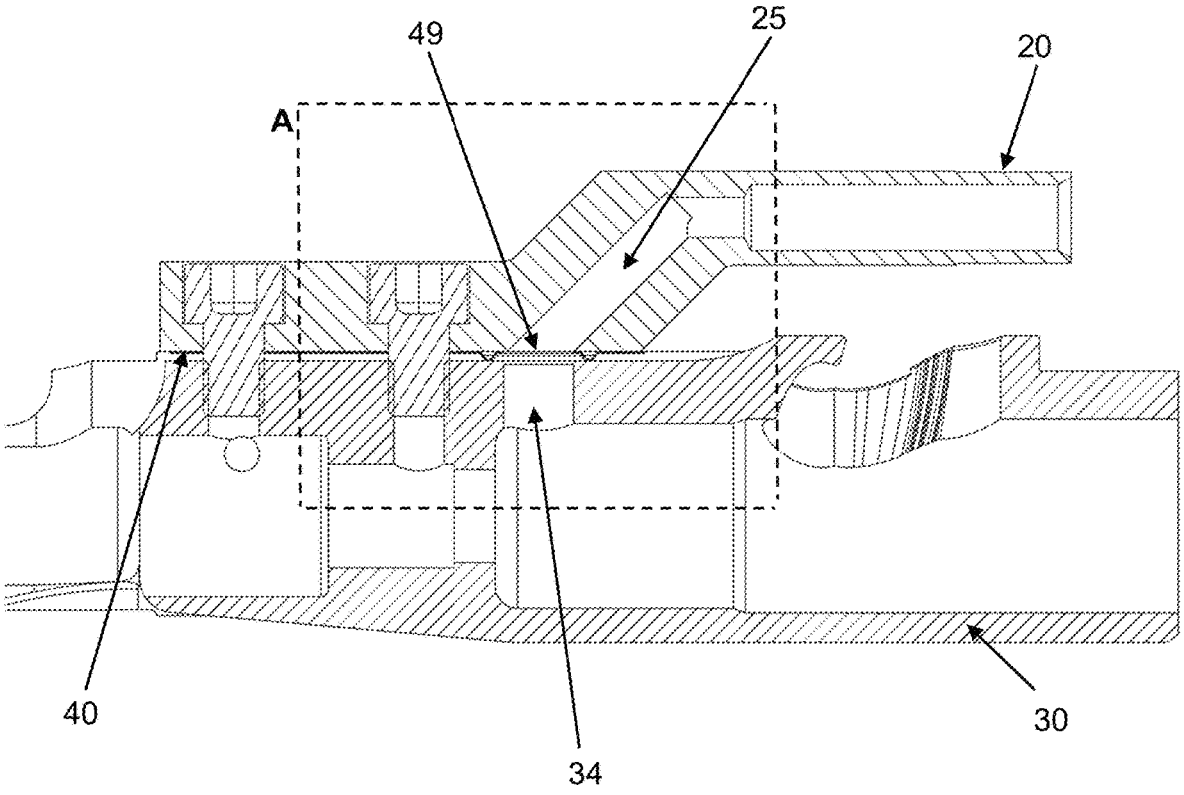
FIG. 8 is a partial front cross-sectional view of the firearm assembly of FIG. 7 taken along the line 8-8 of FIG. 7.
Figure 9:
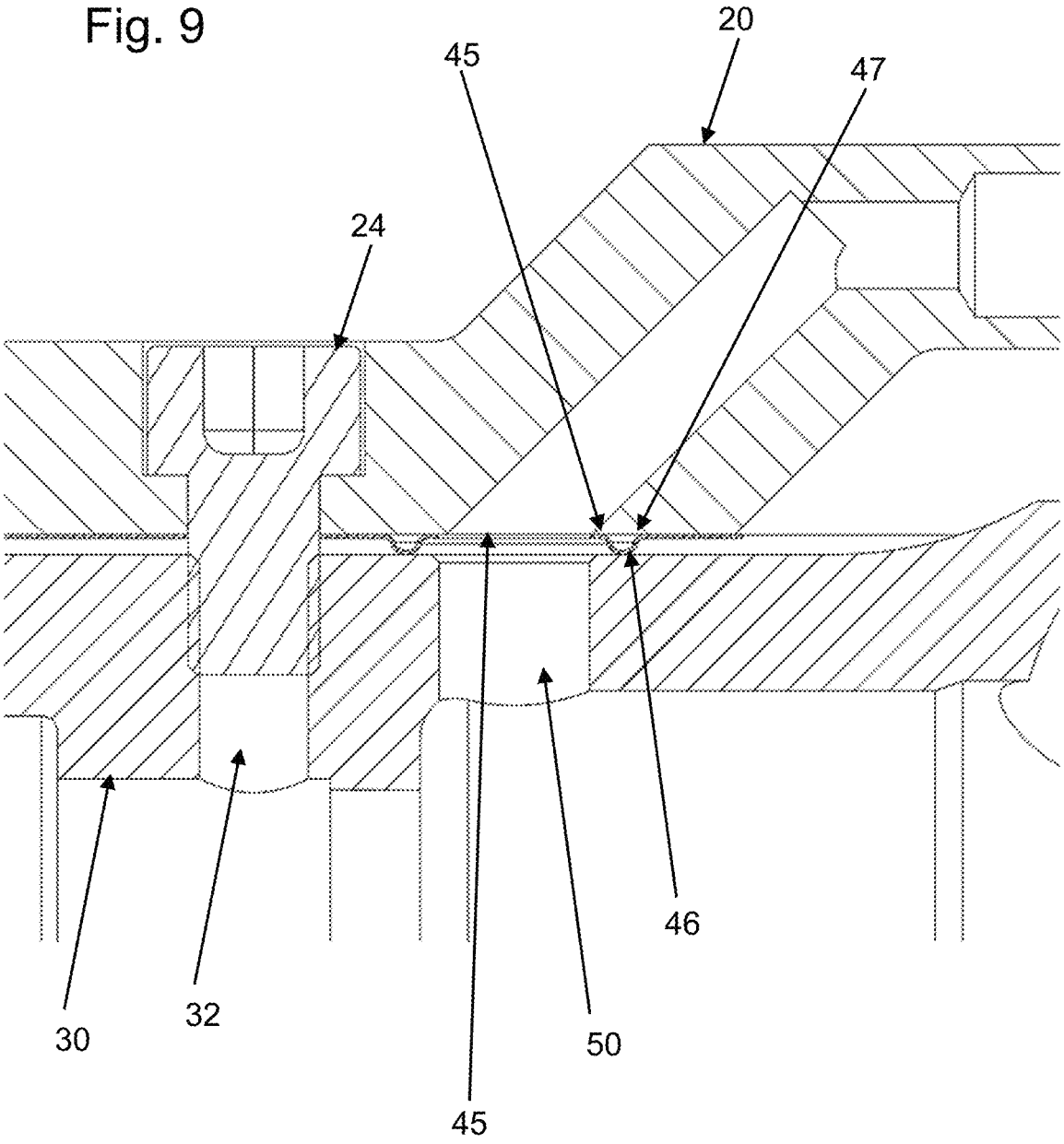
FIG. 9 is a close-up view of the enclosed section A of FIG. 8.

According to embodiments as shown in FIGS. 1 through 9, an assembly 10 for preventing gas leaks in a bolt carrier group of a firearm includes a bolt carrier 30 with a gas hole 34, a bolt carrier gas key 20 attachable to the bolt carrier 30 about the gas hole 34 and a gas key gasket 40 having a metallic material formed with at least one opening such as gas opening 49. As shown in FIGS. 8 and 9, when the bolt carrier 30, gas key gasket 40 and gas key 20 are assembled, the gas hole 34 of the bolt carrier 30 aligns with the gas opening 49 of the gas key gasket 40 and a gas channel 25 formed within the gas key 20. Alignment of the gas hole 34 of the bolt carrier 30 and the gas channel 25 of the gas key 20 will be understood to those of ordinary skill in the art as customary with rifles such as those with which the presently disclosed embodiments can work.

In operation, the gas key 20 can be sealed to the bolt carrier 30 by positioning the embossed gas key gasket 40 between the gas key 20 and the bolt carrier 30, wherein the embossed gas key gasket 40 is positioned about the gas opening 34 formed in the bolt carrier 30. The gas key gasket 40 can then be compressed so as to deform the gas key gasket 40 into one or more contact rings, sealing one or more irregular surfaces on the bolt carrier gas key 20 and/or the bolt carrier 30. The compression of the gas key gasket 40 can take place by tightening the retainer screw(s) 24, which facilitates prevention of potential gas leakage at the interface between the bolt carrier 30 and the gas key 20. In this way, the central ridge 46 on the bottom surface 43, the radially exterior lip 47 of the top surface 41, and the radially interior lip 45 of the top surface 41 of the gas key gasket 40 provide contact rings at the interface between the gas key 20 and the carrier body 30 for sealing as disclosed herein. As the central ridge 46 is compressed, the top surface 41 of the gas key gasket 40 becomes in mating communication with the underside planar surface 23 of the gas key 20 and the top planar surface 33 of the bolt carrier body 30 becomes in mating communication with the bottom surface 43 of the gas key gasket 40. The radially interior lip 45 and the radially exterior lip 47 provide separate contact rings as part of the top surface 41 of the gas key gasket 40, and the central ridge 46 provides a contact ring as part of the bottom surface 43 of the gas key gasket 40. The bolt carrier body 30 thus becomes securely connected to the gas key 20, with the compressed gas key gasket 40 providing an effective sealing component as described herein to prevent gas leakage when the firearm is discharged.

It will be appreciated that the orientation of the gas key gasket 40 between the bolt carrier body 30 and the gas key 20 can be as shown in FIGS. 1, 8 and 9, where the top surface 41 of the gas key gasket 40 engages the gas key 20 and the bottom surface 43 of the gas key gasket 40 engages the bolt carrier body 30, or can also be flipped, where the bottom surface 43 of the gas key gasket 40 engages the gas key 20 and the top surface 41 of the gas key gasket 40 engages the bolt carrier body 30. It will also be appreciated that standard, legacy embodiments of the gas key 20, bolt carrier body 30 and screws 24 can be employed with the gas key gasket 40 according to various embodiments of the present disclosure.

The present disclosure describes numerous embodiments, and these embodiments are presented for illustrative purposes only. These embodiments are described in sufficient detail to enable those skilled in the art to practice the embodiments, and it will be appreciated that other embodiments may be employed and that structural and other changes may be made without departing from the scope or spirit of the presently disclosed embodiments. Accordingly, those skilled in the art will recognize that embodiments of the present disclosure may be practiced with various modifications and alterations. Although particular features of the presently disclosed embodiments can be described with reference to one or more particular embodiments or figures that form a part of the present disclosure, and in which are shown, by way of illustration, specific embodiments, it will be appreciated that such features are not limited to usage in the one or more particular embodiments or figures with reference to which they are described. The present disclosure is thus neither a literal description of all embodiments nor a listing of features of any embodiments that must be present in all embodiments.

The invention claimed is:

1. A gas key gasket for a firearm, comprising:

a monolithic gasket comprising a metallic material formed with at least one opening, wherein the gasket is further formed with a ridge embossment extending circumferentially around the at least one opening, whereupon the ridge embossment can be positioned about an opening in a bolt carrier of a firearm and compressed by a bolt carrier gas key so as to seal one or more irregular surfaces on the bolt carrier gas key and/or the bolt carrier.

2. The gas key gasket of claim 1, wherein the gasket is formed as a substantially flat plane.

3. The gas key gasket of claim 1, wherein the gasket seals the one or more irregular surfaces without adhesive.

4. The gas key gasket of claim 1, wherein the ridge embossment is formed with a radially interior lip, a central ridge and a radially exterior lip.

5. The gas key gasket of claim 4, wherein the radially exterior lip is formed on an edge of a top surface of the gas key gasket.

6. The gas key gasket of claim 5, wherein the central ridge extends downwardly as a first concave arc to a peak and further extends as an opposing concave arc from the peak to the radially interior lip.

7. The gas key gasket of claim 4, wherein upon compression by the bolt carrier gas key, the radially interior lip forms a first contact ring on a top surface of the gasket and the radially exterior lip forms a second contact ring on the top surface of the gasket.

8. The gas key gasket of claim 7, wherein upon compression by the bolt carrier gas key, the central ridge forms a third contact ring on a bottom surface of the gasket.

9. An assembly for preventing gas leaks in a bolt carrier group of a firearm, comprising:

a bolt carrier with a gas hole;

a bolt carrier gas key attachable to the bolt carrier about the gas hole; and a gas key gasket comprising a metallic material formed with at least one opening, wherein the gasket is further formed with a ridge embossment extending circumferentially around the at least one opening, whereupon the ridge embossment can be positioned about the gas hole in the bolt carrier and compressed by the bolt carrier gas key so as to seal one or more irregular surfaces on the bolt carrier gas key and/or the bolt carrier.

10. The assembly of claim 9, wherein the gas key gasket is formed as a substantially flat plane.

11. The assembly of claim 9, wherein the gas key gasket seals the one or more irregular surfaces without adhesive.

12. The assembly of claim 9, wherein the ridge embossment is formed with a radially interior lip, a central ridge and a radially exterior lip.

13. The assembly of claim 12, wherein the radially exterior lip is formed on an edge of a top surface of the gas key gasket.

14. The assembly of claim 13, wherein the central ridge extends downwardly as a first concave arc to a peak and further extends as an opposing concave arc from the peak to the radially interior lip.

15. The assembly of claim 12, wherein upon compression by the bolt carrier gas key, the radially interior lip forms a first contact ring on a top surface of the gasket and the radially exterior lip forms a second contact ring on the top surface of the gasket.

16. The assembly of claim 15, wherein upon compression by the bolt carrier gas key, the central ridge forms a third contact ring on a bottom surface of the gasket.

17. A method for sealing a bolt carrier gas key to a bolt carrier, comprising:

positioning an embossed gas key gasket between a bolt carrier gas key and a bolt carrier, wherein the embossed gas key gasket is positioned about an opening formed in the bolt carrier; and compressing the embossed gas key gasket so as to deform the gas key gasket into at least one contact ring, sealing one or more irregular surfaces on the bolt carrier gas key and/or the bolt carrier.

18. The method of claim 17, wherein compressing the embossed gas key gasket deforms the gas key gasket into a plurality of contact rings.

* * * * *